US005799720A

United States Patent [19]

Ross et al.

[11] Patent Number: 5,799,720

[45] Date of Patent: Sep. 1, 1998

[54] NOZZLE ASSEMBLY FOR CONTINUOUS CASTER

[75] Inventors: Nicholas V. Ross, Youngstown, Ohio; C. Edward Eckert, Kensington, Pa.

[73] Assignee: Ajax Magnethermic Corp., Warren, Ohio

[21] Appl. No.: 703,655

[22] Filed: Aug. 27, 1996

[51] Int. Cl.[6] ..... B22D 11/10; B22D 41/60

[52] U.S. Cl. ..... 164/471; 164/428; 164/432; 164/437; 164/480; 164/481; 164/488; 164/507; 222/591; 222/593

[58] Field of Search ..... 164/471, 479, 164/480, 481, 482, 488, 507, 428, 430, 431, 432, 433, 434, 437; 222/590, 591, 592, 593

[56] References Cited

U.S. PATENT DOCUMENTS

| | | | |
|---|---|---|---|
| 3,774,670 | 11/1973 | Gyöngyös . | |
| 3,799,410 | 3/1974 | Blossey et al. . | |
| 4,153,101 | 5/1979 | Chateau et al. | 164/428 |
| 4,485,835 | 12/1984 | Huber et al. | 164/430 |
| 4,526,223 | 7/1985 | Ai et al. | 164/428 |
| 4,527,612 | 7/1985 | Yu et al. | 164/428 |
| 4,550,766 | 11/1985 | Ai et al. | 164/428 |
| 4,550,767 | 11/1985 | Yu et al. | 164/428 |
| 4,798,315 | 1/1989 | Lauener | 222/591 |
| 4,972,900 | 11/1990 | Szczypiorski | 164/488 X |
| 5,164,097 | 11/1992 | Wang et al. | 222/590 |
| 5,435,375 | 7/1995 | Eckert | 164/437 |
| 5,439,047 | 8/1995 | Eckert | 164/471 |

FOREIGN PATENT DOCUMENTS

| | | | |
|---|---|---|---|
| 57-75265 | 5/1982 | Japan | 222/592 |
| 2-25270 | 1/1990 | Japan | 222/593 |

*Primary Examiner*—J. Reed Batten, Jr.
*Attorney, Agent, or Firm*—Andrew Alexander

[57] ABSTRACT

The assembly is designed for transferring molten metal from a molten metal reservoir to a mold for casting molten metal. The assembly comprises a casting nozzle having an electrically conductive top wall and bottom wall and two side walls joined to the top wall and the bottom wall to form a passage therebetween for flowing molten metal from the reservoir to the mold, the top wall having a first outside surface and the bottom wall having a second outside surface. An inductive heater is positioned on at least one of the first surface and the second surface, the inductive heater positioned to heat the top wall and bottom wall. A layer of insulation is provided between the inductive heater and the first and second surfaces. A magnetic shield is provided to partially surround the inductive heater, the shield positioned to direct magnetic flux into the nozzle. A metal support is provided for supporting the top wall and the bottom wall, a layer of insulation provided between the metal support and the top wall and the bottom wall to minimize heating of the metal support and distortion of the top wall and the bottom wall. Further, the metal support is electrically insulated from the inductive heater to minimize heating of the metal support, and the magnetic shield is positioned to substantially avoid magnetic flux entering the metal support.

32 Claims, 6 Drawing Sheets

NOZZLE ASSEMBLY FOR CONTINUOUS CASTER

BACKGROUND OF THE INVENTION

This invention relates to casting of molten metal such as aluminum into solidified forms such as sheet, plate, bar, ingot or strips and more particularly, this invention relates to an improved nozzle assembly for supplying molten metal to casters such as wheel, roll, belt, block casters and the like.

For purposes of supplying molten metal, e.g. aluminum, to a continuous caster, for example, a roll caster, a casting nozzle is used having a tip which extends into the casting rolls to deliver molten metal to the rolls for solidification. Such tips are shown, for example, in U.S. Pat. Nos. 3,774,670; 4,526,223; 4,527,612; 4,550,766 and 4,798,315.

Casting nozzles have been fabricated from various refractory materials. For example, U.S. Pat. No. 4,485,835 discloses that the part of the nozzle coming in contact with the molten metal is a refractory material comprised of silica, asbestos, sodium silicate and lime, which material is available under the trade names Marinite and Marimet. Further, U.S. Pat. No. 4,485,835 discloses that while the refractory nozzles exhibit good thermal insulation and low heat capacity, it is not very homogeneous in terms of chemical composition and mechanical properties. In addition, it adsorbs moisture and is subject to embrittlement or low mechanical strength upon preheating to operating temperature which allows such nozzles to be used only once. Further, such materials frequently outgas and experience cracking upon heating, both of which are undesirable characteristics for successful caster nozzle performance.

Refractory materials used to fabricate the casting nozzles have not been satisfactory for other reasons. For example, often the refractory material is reactive or subject to erosion or dissolution by the molten metal, e.g., aluminum, being cast, and this results in particles of refractory or reaction products ending up in the cast product.

Another problem with refractory material is that it often cannot maintain the proper strength level under operating conditions. This can result in sag or change in its dimensions which adversely affects or changes the flow of molten metal to the casting mold. That is, the flow of molten metal across the tip of the nozzle does not remain uniform. This can change the freeze front and thus properties can change across the width of the product. Change of the internal dimensions of the nozzle can result in metal flow disturbances and surface defects on the resulting sheet or plate such as eddy currents, turbulence or otherwise non-uniform flow through the nozzle.

Yet, another problem with refractory-type nozzles is that often they are not reusable. That is, after molten metal has been passed once through the nozzle and the caster has been shut down, the nozzle is not reusable. Thus, a new nozzle, even if it has only been used for a short time cannot be used again. This greatly adds to the expense of operating the caster.

Reproducibility with respect to the dimensions of the refractory nozzles is a problem. For example, some nozzles may be found to work acceptably and others have been found to be unacceptable because tolerances are difficult to maintain. This leads to a very high rejection rate for nozzles which again adds greatly to the cost of operating the caster.

Before molten metal is poured into the nozzle, it is preferred to heat the nozzle to minimize warpage and to avoid prematurely cooling the molten metal. However, with refractory materials, it is difficult to heat the nozzle uniformly. Traditionally, nozzles have been heated by impinging a gas flame on the nozzle or placing an electric heating unit inside the channels of the nozzle. However, this results in heating non-uniformly within the same nozzle and further results in heating non-uniformly from nozzle to nozzle. Further, this form of heating has the problem of open flame or the extra step of removing the heating unit prior to pouring molten metal thereinto. Additionally, these methods of preheating the nozzle do not readily permit the use of such heating means after the metal has been introduced or control of molten metal temperature after it enters the nozzle.

To minimize sagging experienced with nozzles, the above-noted U.S. Pat. Nos. 4,526,223; 4,527,612; 4,550,766 and 4,550,767 disclose the use of spacers. U.S. Pat. No. 4,153,101 discloses a nozzle having a lower plate and an upper plate separated by cross pieces. Outside of the nozzle is an extension on either side of the nozzle referred to as a cheek which is divergent. U.S. Pat. No. 3,799,410 discloses the use of baffles to control the flow of molten metal to a casting machine. U.S. Pat. No. 5,164,097 discloses the use of a solid titanium liner in a crucible and nozzle for casting molten titanium.

More recently, a titanium composite has been used for nozzles for delivering molten metal such as molten aluminum to continuous casters such as belt or roll casters. Such nozzles are described in U.S. Pat. Nos. 5,435,375, 5,439,047, and incorporated herein by reference. U.S. Pat. No. 5,439,047 discloses the use of heating a titanium composite nozzle using an induction heater prior to flowing molten metal therethrough.

Before delivering molten metal to the nip of the belts or rolls, the nozzle has to be positioned very carefully to insure a fit which prevents leakage of molten metal. Because the fit between the nozzle and the belts or rolls is very precise, care must be exercised to ensure that the nozzle does not touch the belts or rolls, which would result in damage to these parts. When a nozzle is heated, for example, by induction heat or by molten metal entering the nozzle, the nozzle can expand at a different rate from the nozzle support. This difference in expansion can cause the nozzle to warp or be pushed into the belts or rolls resulting in damage. Further, warping or distorting can interfere with the flow characteristics of the nozzle resulting in poor casting performance or in cast products having detrimental surface streaks.

From the above, it will be seen that there is a great need for a nozzle assembly which solves these problems and permits continued use of nozzle without warping or distorting and its attendant problems. The present invention provides such a nozzle assembly which can be preheated and which can be fabricated for use with any type of caster, including wheel, roll, block or belt casters. Further, the nozzle, in accordance with the invention has the advantage that it can be uniformly electrically heated by induction to bring the nozzle to operating temperature without warping or distorting caused by the nozzle support.

SUMMARY OF THE INVENTION

It is an object of the present invention to provide an improved nozzle assembly for casting molten metal.

It is another object of the present invention to provide an improved nozzle casting assembly for a wheel, roll, block or belt caster.

Yet, it is another object of the present invention to provide an improved nozzle assembly for a continuous caster which can be inductively preheated without distortion before introducing molten metal thereto.

A further object of the invention is to provide an improved inductor heater suitable for use with a caster nozzle which selectively heats the nozzle.

And a further object of the invention is to provide a novel combination of nozzle, nozzle support and induction heater for a continuous caster.

These and other objects will become apparent from the specification, drawings and claims appended hereto.

In accordance with these objects, there is provided an improved casting assembly for a continuous caster, the assembly designed for transferring molten metal from a molten metal reservoir to a mold for casting molten metal. The assembly comprises a casting nozzle having an electrically conductive top wall and bottom wall and two side walls joined to the top wall and the bottom wall to form a passage therebetween for flowing molten metal from the reservoir to the mold, the top wall having a first outside surface and the bottom wall having a second outside surface. An inductive heater is positioned on at least one of the first surface and the second surface, the inductive heater positioned to heat the top wall and bottom wall. A layer of electrical insulation is positioned between the inductive heater and the surfaces. A magnetic shield is provided to partially surround the inductive heater, the shield positioned to direct magnetic flux into the nozzle. A metal support is provided for supporting the top wall and the bottom wall, the metal support thermally insulated from the top wall and the bottom wall to minimize heating of the metal support and distortion of the top wall and the bottom wall. Further, the metal support is electrically insulated from the inductive heater to minimize heating of the metal support, and the magnetic shield is positioned to substantially avoid magnetic flux entering the metal support.

DETAILED DESCRIPTION OF THE PREFERRED EMBODIMENTS

Figure 1:
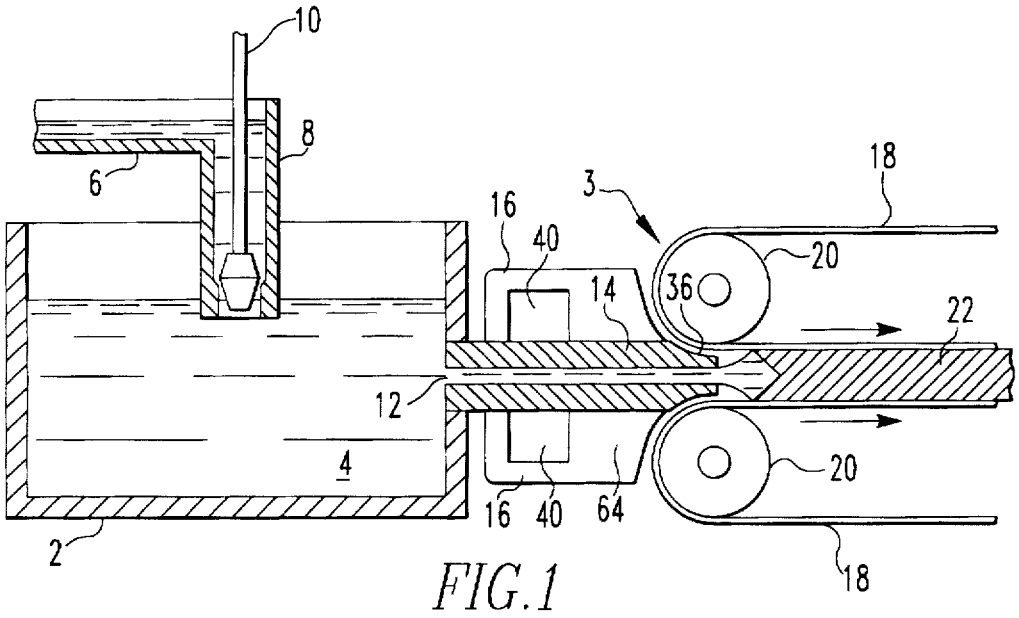
FIG. 1 is a cross section through a schematic of a molten reservoir or tundish, nozzle with inductive heater and a belt caster which provides a continuously advancing mold.

Referring now to FIG. 1, there is shown a schematic of a belt casting apparatus 3 for casting molten metal including reservoir or tundish 2 for molten metal 4 which is introduced through conduit 6 and metered through downspout 8 using control rod 10. Molten metal is introduced through opening 12 in reservoir 2 to nozzle or tip 14 held in place by support blocks 16. Molten metal passes through nozzle 14 to revolving belts 18 which form a continuously advancing mold with revolving end dams (not shown) at both edges of belts 18. Belts 18 are turned by rolls 20, and molten metal is solidified between belts 18 which may be chilled to form a solid 22 such as a sheet, slab or ingot.

Figure 2:
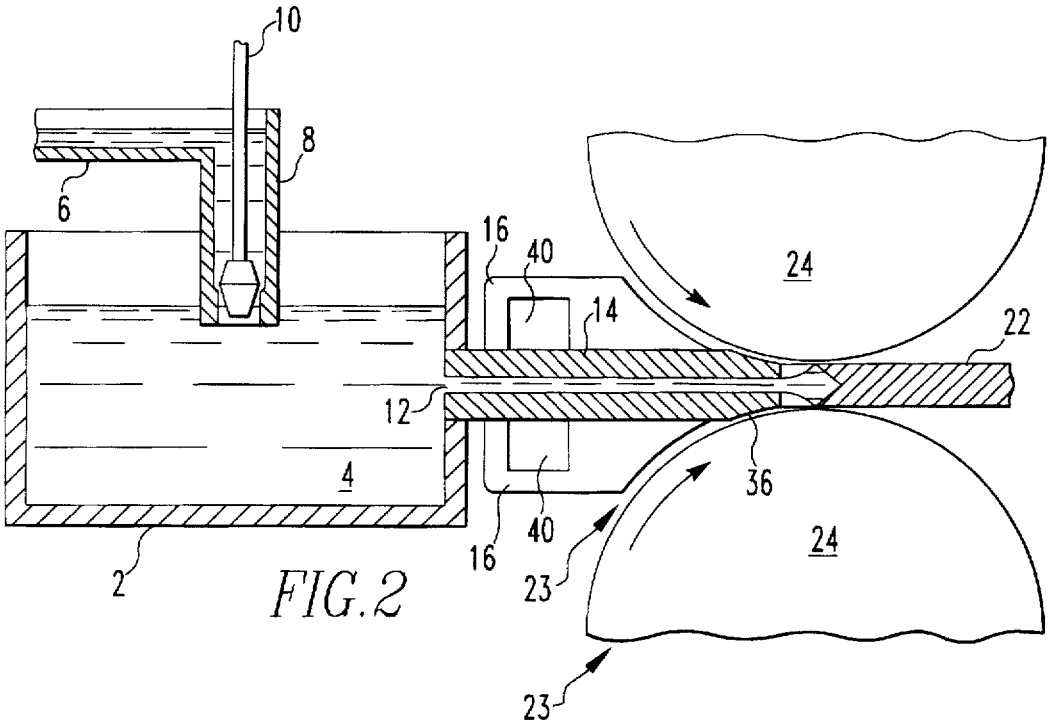
FIG. 2 is a cross section through a schematic of a molten reservoir or tundish, nozzle with inductive heater and a roll caster illustrating the advancing mold.

With respect to FIG. 2, there is shown another casting apparatus 23 referred to as a roll caster including rolls 24 which rotate as shown to provide said continuously advancing mold. That is, as noted with respect to belt caster 3, there is provided a tundish 2 containing molten metal 4, and an inlet 6 which transfers or meters molten metal to tundish 2 through downspout 8 using control rod 10. A nozzle assembly, which includes nozzle or tip 14 and support blocks 16, transfers molten metal through opening 12 and tip 14 to the continuously advancing mold defined by rolls 24. The rolls may be chilled to aid in solidification of molten metal 4 to form solid 22 which may be in sheet, slab or ingot form.

Figure 3:
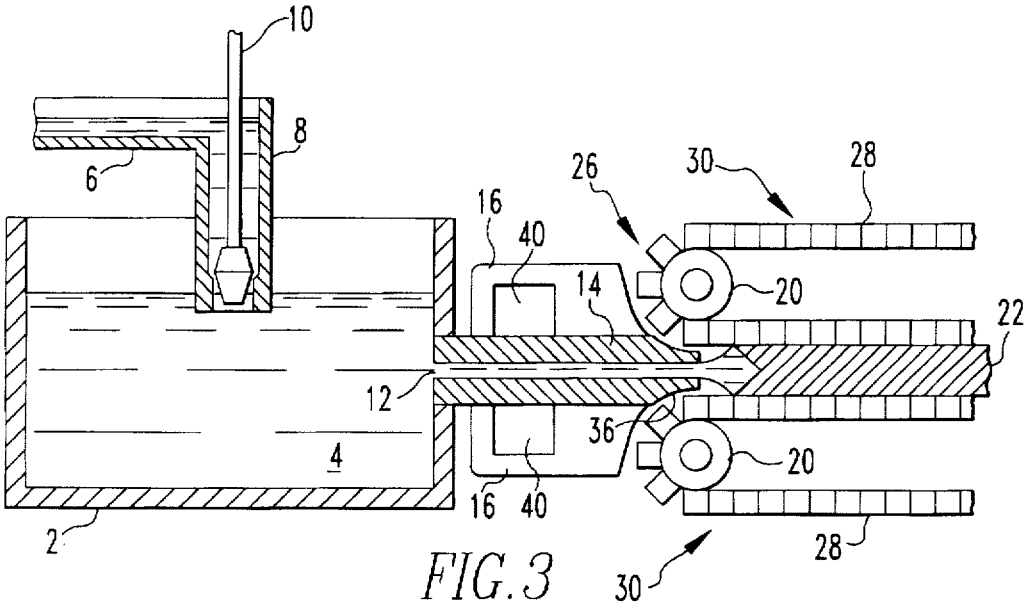
FIG. 3 is a cross section through a schematic of a molten reservoir or tundish, nozzle with inductive heater and a block caster illustrating the advancing mold.

In FIG. 3 is shown another schematic of a casting apparatus 26 in the form of belts 30 formed by blocks 28 which are connected to form said belts and often referred to as a block caster. As described with respect to the belt caster and roll caster, there is provided a tundish or reservoir 2 containing molten metal 4 which is metered to the tundish along conduit 6 and along downspout 8. The molten metal passes through opening 12 and through nozzle 14 held by support blocks 16. Block belts 30 and end dams (not shown) provide a continuously advancing mold therebetween as the belts are turned by rolls 20 wherein the molten metal is contained until solidification occurs to provide a solid 22 in the form of slab, ingot or sheet. The block belts may be chilled to facilitate solidification of the metal.

Figure 5:
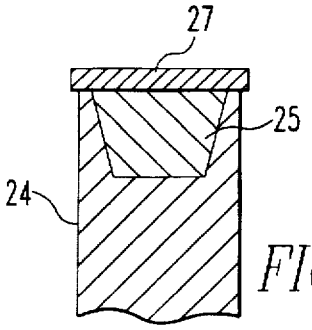
FIG. 5 is a cross section through the wheel caster of FIG. 4.
Figure 4:
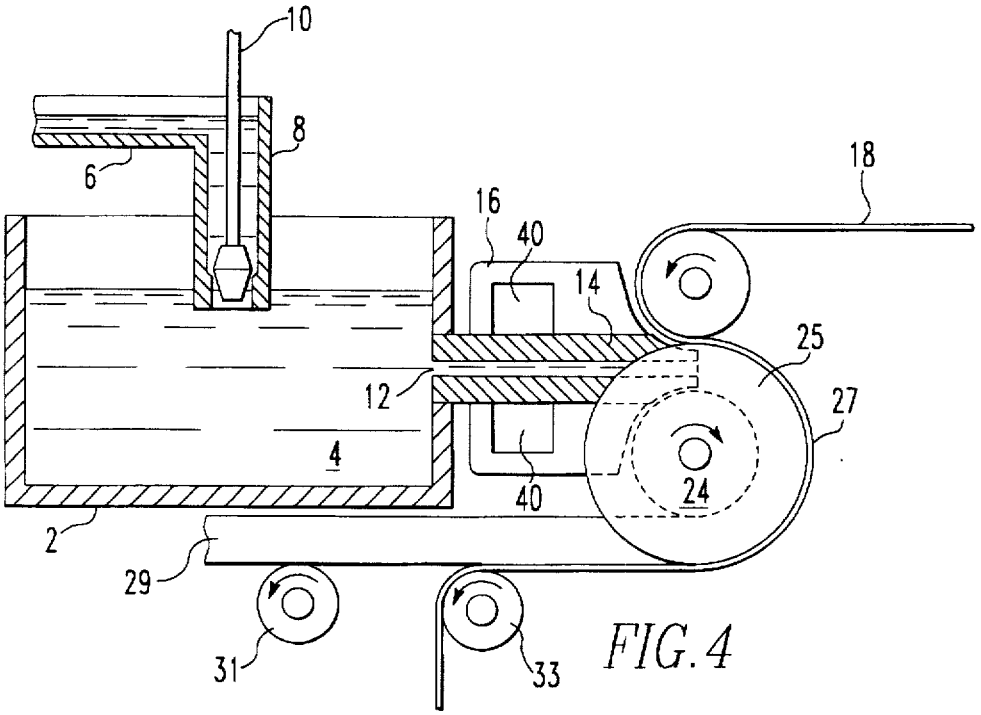
FIG. 4 is a cross section through a schematic of a molten reservoir or tundish, nozzle with inductive heaters and a wheel caster and belt which provides a continuously advancing mold.

In FIGS. 4 and 5 there is shown yet another continuous caster referred to as a wheel caster which comprises a tundish 2 containing molten metal 4 which is introduced through conduit 6 and metered through downspout 8 using control rod 10. Molten metal is introduced through opening 12 in tundish 2 and along nozzle 14 held in place by nozzle support blocks 16. Molten metal passes through nozzle 14 into trough shaped hollow 25 of wheel 24 where the molten metal is held in place by belt 27 until it solidifies by internal cooling, for example. Solidified metal 29 passes over roller 31 and belt 27 is separated therefrom at roller 33. It will be appreciated that the nozzle may be used for other casting operations such as other continuous casting operations wherein molten metal is introduced to a mold such as a four-sided mold and withdrawn therefrom in solidified form.

The nozzle of the present invention may be fabricated out of any material that is electrically conductive. For example, such material can include refractory, graphite or metal. The preferred material for fabrication of nozzle or tip 14 is a metal suitable for contacting molten metal and which material is resistant to dissolution or erosion by the molten metal. A metal coated with a material such as a refractory resistant to attack by molten metal is suitable for the nozzle. In addition, a suitable material typically has a room temperature yield strength of at least 10 KSI and preferably in excess of 25 KSI. Preferred metal nozzles are fabricated from metals such as cast iron, titanium, copper and steel, depending to some extent on the molten metal being cast.

Further, the material of construction should have a thermal conductivity of less than 30 BTU/ft·hr·°F. and preferably less than 15 BTU/ft·hr·°F. with a most preferred material having a thermal conductivity of less than 10 BTU/ft·hr·°F. Another important feature of a desirable nozzle is thermal expansion. This is important to maintain dimensional stability and tolerances when the tip is positioned with respect to the continuously advancing mold. Thus, a suitable material should have a thermal expansion coefficient of less than $15\times10^{-6}$ in/in·°F. with a preferred thermal expansion coefficient being less than $10\times10^{6}$ in/in·°F. and the most preferred being less than $5\times10^{-6}$ in/in·°F. Another feature important of the material useful in the present invention is chilling power. Chilling power is important, for example, when the material is used in a nozzle to prevent the molten metal from freezing at the start of a cast. Chilling power is defined as the product of heat capacity, thermal conductivity and density. Thus, preferably the material in accordance with the invention has a chilling power of less than 500, preferably less than 400 and typically in the range of 100 to 360 $BTU^2/ft^4$·hr·°F. Further, preferably, the material is capable of being heated by induction heating. Additionally, it is preferred that the material does not give off gases when subjected to operating temperatures. In addition, it is important that the material not permit growth or build-up of intermetallic compounds. Further, it is important that the inside surfaces are smooth and free of porosity. For purposes of re-using, it is preferred that the nozzle can be cleaned to remove residual solidified metal.

When casting molten aluminum, the preferred material for fabricating into nozzles is a titanium base alloy having a thermal conductivity of less than 30 BTU/ft·hr·°F., preferably less than 15 BTU/ft·hr·°F. and typically less than 10 BTU/ft·hr·°F. and having a thermal expansion coefficient less than $15\times10^{-6}$ in/in·°F., preferably less than $10\times10^{19\ 6}$ in/in·°F. and typically less than $5\times10^{-6}$ in/in·°F.

When the molten metal being cast is lead, for example, the titanium base alloy need not be coated to protect it from dissolution. For other metals, such as aluminum, copper, steel, zinc and magnesium, refractory-type coatings should be provided to protect against dissolution of the metal tip by the molten metal.

The titanium alloy which can be used is one that preferably meets the thermal conductivity requirements as well as the thermal expansion coefficient noted herein. Further, typically, the titanium alloy should have a yield strength of 30 KSI or greater at room temperature, preferably 70, and typical 100 KSI. The titanium alloys useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect the inside surfaces of the metal nozzle exposed to molten metal from dissolution or attack, a refractory coating can be applied. The refractory coating can be any refractory material which provides the nozzle with a molten metal resistant coating and the refractory coating can vary depending on the molten metal being cast. Thus, a novel composite material is provided permitting use of metals having the required thermal conductivity and thermal expansion for use with molten metal which heretofore was not deemed possible. The refractory coating may be applied both to the inside and outside of the nozzle. When coated on the outside, it aids in protection from oxidation. Further, the refractory coating minimizes skull or metal buildup on nozzle trailing edges.

When the molten metal to be cast is aluminum, magnesium, zinc, or copper, etc., a refractory coating may comprise at least one of alumina, zirconia, yttria stabilized zirconia, magnesia, magnesium titanite, or mullite or a combination of alumina and titania. While the refractory coating can be used on the metal comprising the nozzle, a bond coating can be applied between the base metal and the refractory coating. The bond coating can provide for adjustments between the thermal expansion coefficient of the base metal alloy, e.g., titanium and the refractory coating when necessary. The bond coating thus aids in minimizing cracking or spalling of the refractory coat when the nozzle is heated to the operating temperature. When the nozzle is cycled between operating temperature and room temperature, for example, when the nozzle is reused, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils units with a typical thickness being about 0.5 mils. The bond coating can be applied by sputtering, plasma or flame sprayed, chemical vapor deposition, spraying or mechanical bonding by rolling, for example.

After the bond coating has been applied, the refractory coating is applied. The refractory coating may be applied by any technique which provides a uniform coating over the bond coating. The refractory coating can be applied by aerosol sputtering, plasma or flame spraying, for example. Preferably, the refractory coating has a thickness in the range of 4 to 22 mils, preferably 5 to 15 mils with a suitable thickness being about 10 mils. The refractory coating may be used without a bond coating.

When the nozzle or tip is fabricated from a refractory such Marinite or Marimet or other poorly conducting materials, conductive receptor material may be mixed with the refractory prior to forming into said nozzle to improve its electrical conductivity. The conductive receptor material may comprise a metal, e.g., steel, flake or powder. Further, the conductive receptor material may comprise graphite powder, for example. The amount and type of conductive receptor material is dependent on the metal to be cast.

Prior to passing molten metal from the tundish or reservoir to nozzle 14, it is preferred to heat the nozzle to a temperature close to the operating temperature. For casting molten aluminum, the temperature to which it is preferred to heat the nozzle is in the range of 750° to 950° F. However, heating to a temperature range of 400° to 1300° F. is contemplated and is beneficial particularly at the higher end of the range.

The subject invention permits the use of electrical heating. That is, in a preferred aspect of the invention, the nozzle of the invention is heated by induction heating. For purposes of inductive heating of nozzle 14, induction heaters 40 (See FIGS. 1, 2, 3 and 4) are provided and held in place by support blocks. For purposes of heating, induction heaters 40 should extend substantially across the width of the nozzle.

Figure 6:
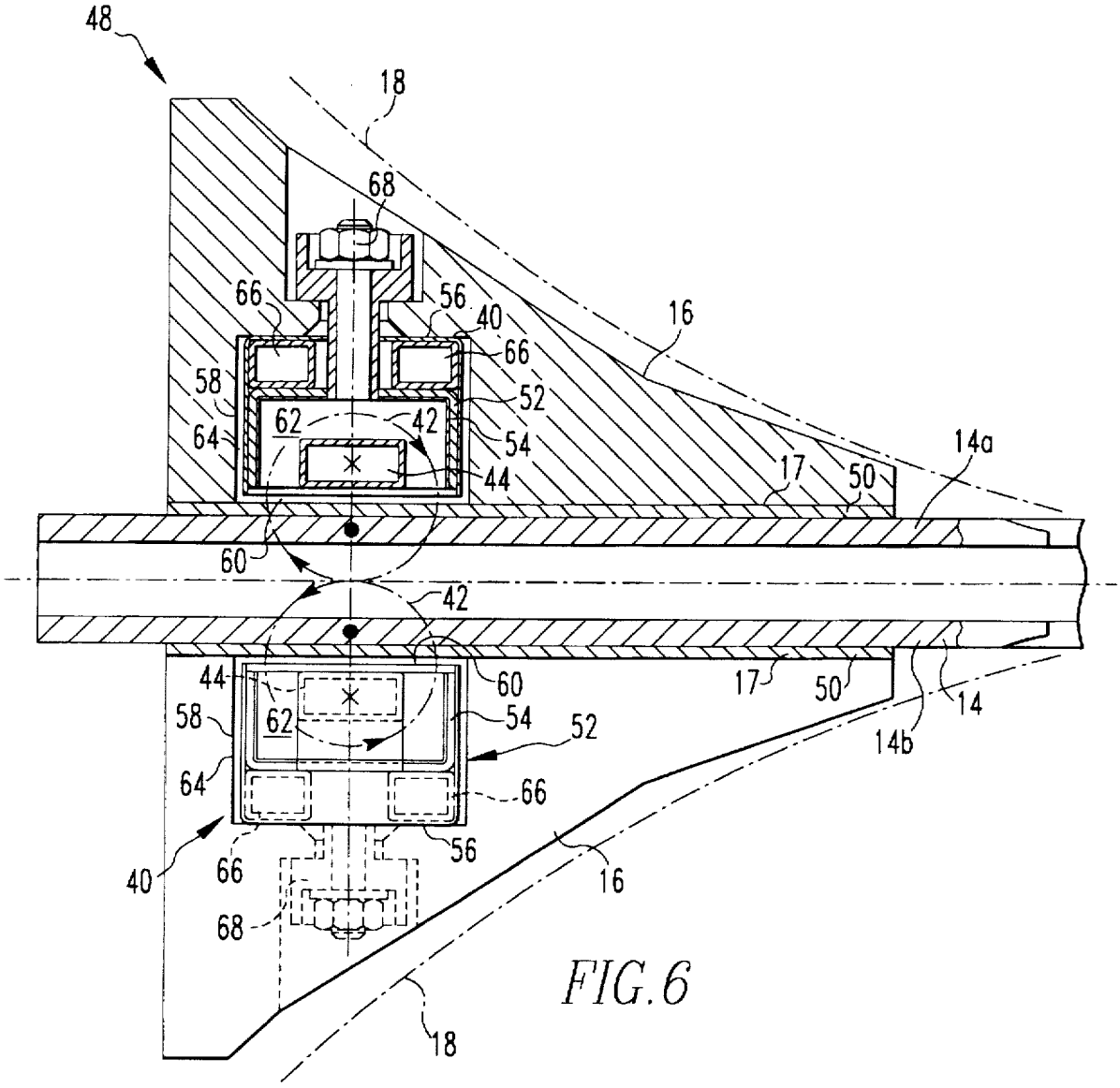
FIG. 6 is a cross-sectional view along the nozzle showing the nozzle positioned between two support blocks having two induction heaters for heating the nozzle.

A cross-sectional view of a nozzle assembly 48 comprised of a nozzle 14, support blocks 16 having incorporated therein induction heaters 40 in accordance with the invention is shown in FIG. 6. That is, in this embodiment support blocks 16 are provided to hold nozzle 14 in a fixed position with respect to the nip of the belt caster or roll caster. Thus, support blocks 16 clamp nozzle 14 in position. Support blocks 16 are usually fabricated from carbon steel; however, other steels or metals may be used. For example, alloys of iron and nickel, referred to as Invar, may be used. Such alloys have a thermal low coefficient of expansion and thus permit precise positioning of the nozzle with respect to the nip of the casting rolls or belts. In the present invention, it is desired to heat or preheat nozzle 14 before molten metal is introduced thereto at start-up to avoid thermal shock and for temperature control of the molten metal being introduced to the casting unit. However, it is desired to heat nozzle without heating or with only minimal heating of support blocks 16. That is, for best casting practices, once the nozzle has been positioned with respect to the nip or entrance to the belt caster or roll caster, for example, distortion or movement of any kind of the nozzle relative to the nip should be avoided. For example, movement of nozzle 14 upwardly or downwardly can seriously damage the nozzle or the belts or rolls, resulting in downtime for repairs. Thus, surfaces 17 of support blocks 16 which are abutted or clamped against the nozzle are provided with a thermal insulation layer 50. Layer 50 can be comprised of any insulation which is effective in minimizing heat transferred from nozzle 14 to support blocks 16. Preferred layers 50 can be comprised of a material selected from zirconia, titania, alumina and silica or combinations of these materials or other such electrically non-conductive refractory oxides. Typically, the thickness of insulation layer 50 ranges from about 0.01 to 0.25 (inch). A suitable electrical non-conductive thermal insulation material is available from E. I. DuPont de Nemours & Co. under the trade name ZIRCORE®. Layer 50 may be applied as a castable cement bonded to support block 16 or layer 50 can be applied by sputtering, plasma or flame spraying, for example. Thus, it will be seen that in the present invention, selection of the material for layer 50 is important in that the layer is required to have good thermal insulation properties as well as being electrically non-conductive.

While insulation layer 50 in FIG. 6 is shown having a uniform thickness, layer 50 may have increased thickness at locations not directly under induction heaters 40 to provide for additional insulation against transferring heat to support blocks 16. It will be appreciated that electrical insulation is required between inductive heaters 40 and nozzle 14 to prevent electrical short circuiting.

In a preferred embodiment, nozzle assembly 48 is comprised of two induction heaters 40 disposed or positioned substantially opposite each other as shown in FIG. 6 and electrically phased to produce magnetic flux which flows in the same direction in the nozzle. That is, induction heaters 40 are operated to compliment each other by providing a magnetic flux direction or field 42 substantially as shown in FIG. 6. Thus, in FIG. 6, electrical current flows through conductors 44 in a direction into the sheet of the drawings.

Figure 7:
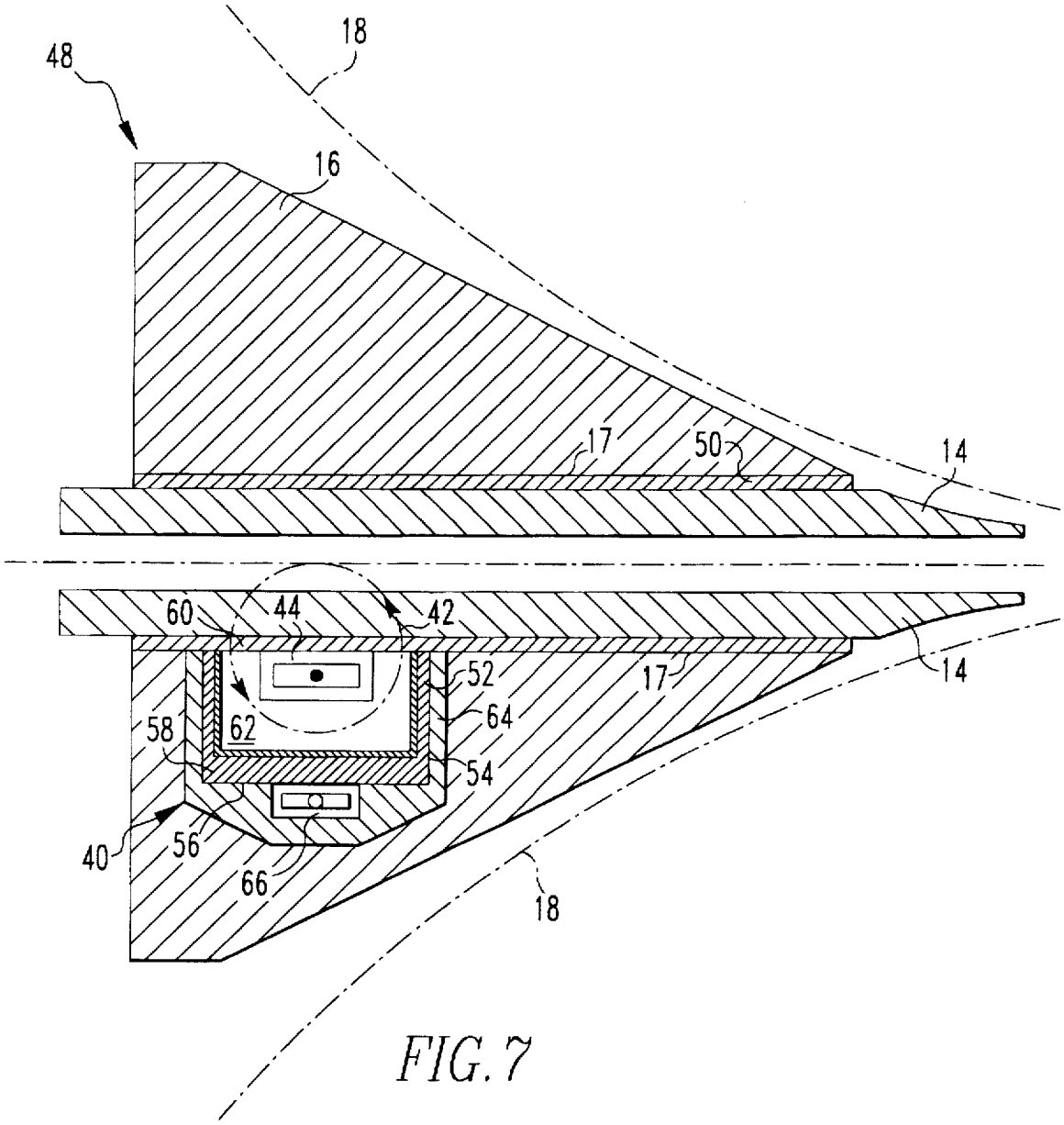
FIG. 7 is a cross-sectional view along the nozzle showing the nozzle positioned between two support blocks and one induction heater for heating the nozzle.

Controlling the flow of the magnetic flux field is an important aspect of the present invention. That is, in the present invention, the magnetic flux is directed to flow into the top or bottom plates or walls of nozzle 14 and to minimize flow into support blocks 16. For purposes of directing the magnetic flux away from the support blocks and into nozzle 14, a magnetic shield 52 surrounds the induction heater on sides adjacent support blocks 16. As shown in FIGS. 6 and 7, magnetic shield 52 is provided on sides 54, 56 and 58. However, side 60 adjacent nozzle 14 does not have a magnetic shield. Thus, the magnetic flux is not restricted on side 60 where it enters the nozzle for purposes of heating. The magnetic shield may be comprised of any material which is effective in shielding the magnetic flux from the support blocks. Typically, magnetic shield materials are fabricated from copper, silicon steel and μ-metal. A preferred material for fabrication of the shield is comprised of copper. Also, preferably conductor 44 is comprised of copper. The shield also may be utilized for the return flow of the electrical current.

Figure 10:
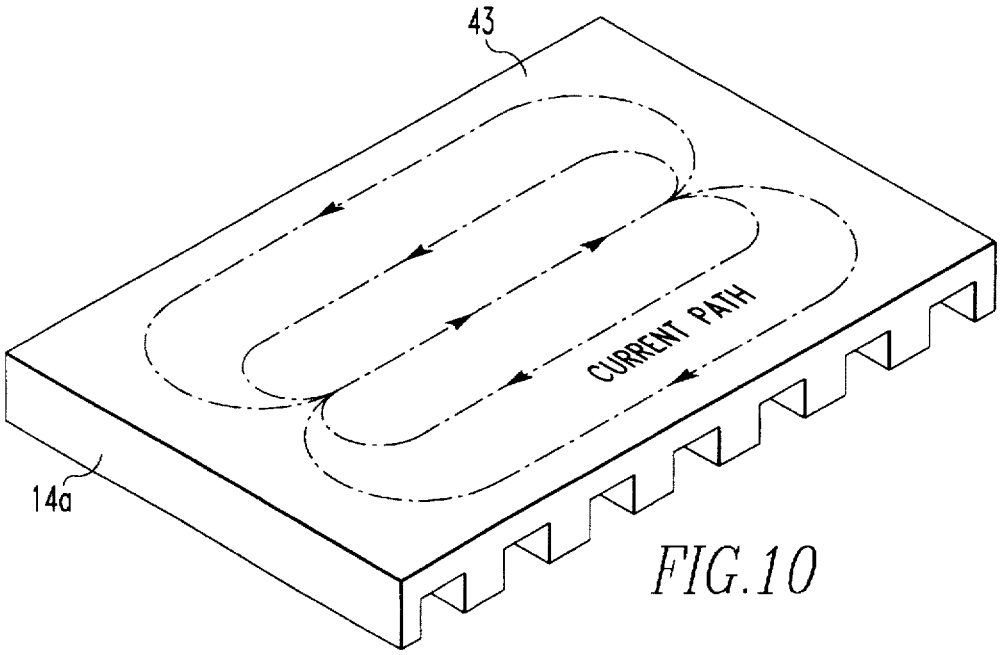
FIG. 10 is a dimensional view of a top part of the nozzle showing current flow induced in the top part of the nozzle by the induction heater.

FIG. 10 is an illustrative view of the top part or plate **14*a* of nozzle 14. When a magnetic flux 42, as shown in FIG. 6, is induced on top part of nozzle 14, an electric current 43 flows substantially as illustrated in FIG. 10 thereby providing heating of the top part 14*a* of plate comprising nozzle 14. When an induction heater is used on the bottom, as shown in FIG. 6, for example, electrical current is induced to flow in a similar manner thereby causing heating of the bottom part or half 14*b* of nozzle 14**.

In one embodiment of the invention, preferably induction heaters 40 are supported in silicon steel laminations 62 which are encapsulated by magnetic shield 52 on sides 54, 56 and 58. Further, preferably, magnetic shield 52 is electrically insulated from support block 16 by a layer of electrical insulation 64 provided on sides 54, 56 and 58 between the induction heater and the support block. It should be noted that conductors 44 are electrically insulated (not shown) from the silicon steel laminations. While silicon steel has been used for the magnetic flux guard or guide, any suitable material can be used, for example, compressed powdered iron.

In the present invention, electric current is directed along conductors 44 into the plane of the paper and is returned along magnetic shield 52 in a direction out of the paper.

For purposes of cooling or controlling the temperature of induction heaters 40, a liquid such as water is passed through conduits or channels 66. Other means of cooling are contemplated. For example, a non-aqueous system may be employed for cooling purposes. The non-aqueous system can employ glycols such as ethylene glycol. Also, low melting point metals or metal alloys such as lead, bismuth, tin and the like or alloys of these metals may be employed.

Further, the cooling means may comprise a water vapor cooling system wherein water vapor is employed above about 250° F. For purposes of using water vapor, the conduits or channels can be open. Water vapor is introduced through conduits 66 and then discarded or condensed and recycled. While two conduits are shown, a further conduit can be placed or located on sides 54 and 58, further ensuring against heat build-up in support block 16. In yet another embodiment, a single conduit 66 may be used as shown in FIG. 7. In FIG. 6, it will be seen that induction heaters 40 are held in place by nut and bolt type assembly 68. In this way, induction heater 66 is held in the recess in support block 16.

While it is noted that two induction heaters are preferred, a single induction heater may be employed, as shown in FIG. 7 wherein like numbers describe like parts. In FIG. 7, a single conduit 66 for cooling water is used. The induction heater can be constructed and operated substantially as described above.

Figure 8:
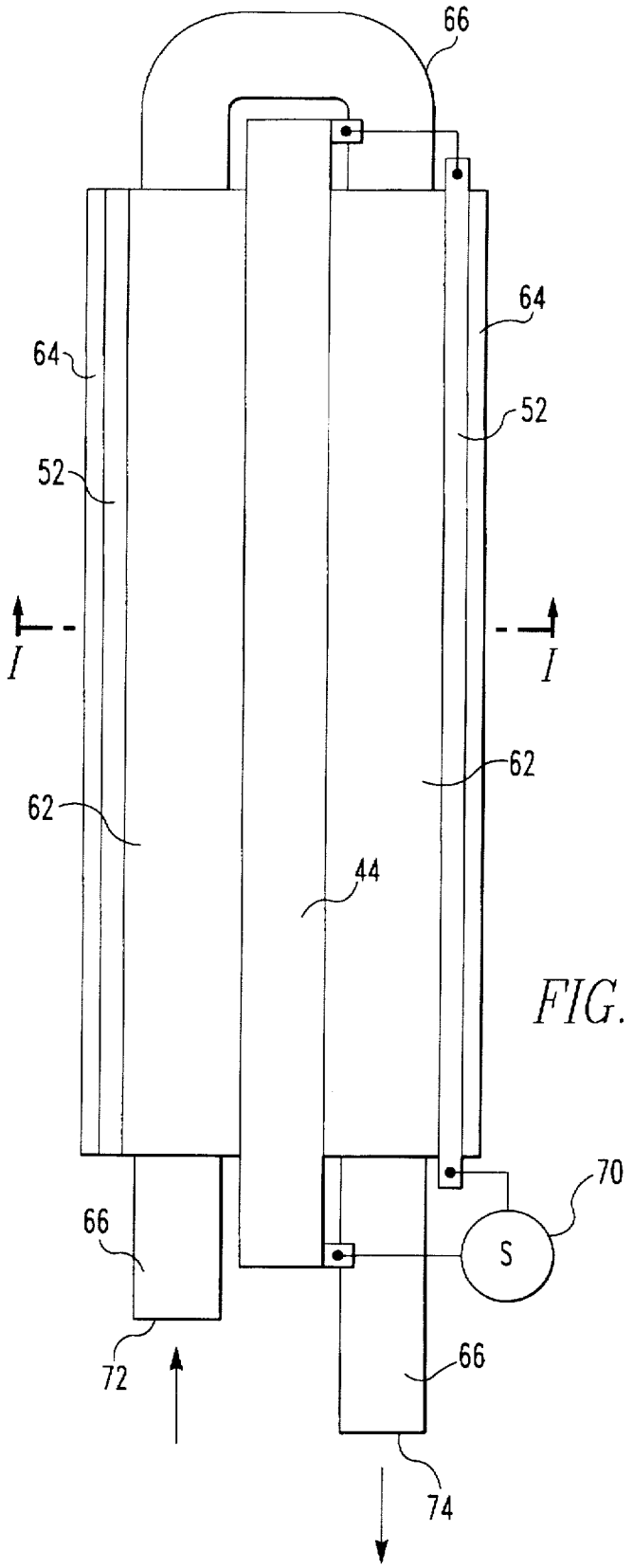
FIG. 8 is a schematic of an induction heater suitable for heating the nozzle.
Figure 9:
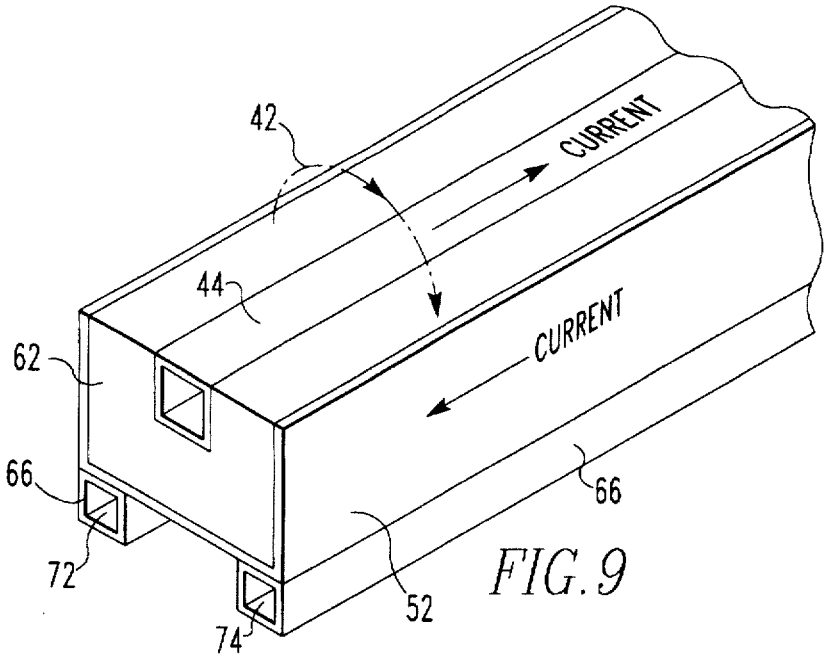
FIG. 9 is a cross-sectional view along the line I—I of FIG. 8 showing a dimensional view through the induction heater indicating current flow.

An induction heater assembly is shown in FIGS. 8 and 9 which is suitable for heating a metal nozzle in accordance with the invention. FIGS. 8 and 9 show the surface of the induction heater assembly which is closest to the nozzle top or bottom wall. In FIG. 8, there is shown an adjustable power source 70 connected to conductor 44 and to magnetic flux shield 52. Current supplied by power source 70 travels along conductor 44 and is returned along shield 52 (see also FIG. 9), both of which are in electrical communication with power source 70. Electrical insulation 64 is shown for electrically insulating magnetic shield 52 from the support block. Metal lamination 62 are shown surrounding conductor 44. To control the temperature of the conductor, a liquid or other cooling means such as water is introduced through end 72 of conduit 66 and removed through the opposite end 74. Conduit 66 may be U-shaped or may be a straight conduit where liquid is discharged without being returned.

FIG. 9 is a view along the line I—I of FIG. 8 illustrating the magnetic flux field 42 and its inducement into bottom plate **14*b* of nozzle 14. That is, electrical current flows in the direction indicated along conductor 44 and is returned along shield 52. As noted, coolant is introduced along conduit 66**.

While the invention has been described in terms of preferred embodiments, the claims appended hereto are intended to encompass other embodiments which fall within the spirit of the invention.

What is claimed is:

1. An improved casting assembly for a continuous caster, the assembly designed for transferring molten metal from a molten metal reservoir to a mold for casting molten metal, the assembly comprising:

(a) a casting nozzle having an electrically conductive top wall and bottom wall and two side walls joined to said top wall and said bottom wall to form a passage therebetween for flowing molten metal from said reservoir to said mold, said top wall having a first outside surface and said bottom wall having a second outside surface;

(b) an inductive heater positioned on at least one of said first surface and said second surface, said inductive heater positioned to heat said top wall and bottom wall and having a magnetic shield partially surrounding said inductive heater, the shield positioned to direct magnetic flux into said nozzle; and (c) a layer of electrical insulation provided between said inductive heater and said first and second surface;

(d) a support for supporting said top wall and said bottom wall, a layer of insulation provided between said support and said top wall and said bottom wall to minimize heating of said support and distortion of said top wall and said bottom wall, said support electrically insulated from said inductive heater, said magnetic shield positioned to substantially avoid magnetic flux entering said support.

2. The casting assembly in accordance with claim 1 wherein an inductive heater is positioned on said top surface and a second inductive heater is positioned on said bottom surface.

3. The casting assembly in accordance with claim 1 wherein said casting nozzle is a metal casting nozzle.

4. The casting assembly in accordance with claim 1 wherein said casting nozzle is a cast iron casting nozzle.

5. The casting assembly in accordance with claim 1 wherein said casting nozzle is a titanium casting nozzle.

6. The casting assembly in accordance with claim 1 wherein said casting nozzle is a titanium nozzle having refractory coating in the inside passages thereof, the refractory coating resistant to attack by molten metal passing through said nozzle.

7. The casting assembly in accordance with claim 1 wherein the casting nozzle is comprised of a refractory material containing an electrical conductive receptor material.

8. The casting assembly in accordance with claim 1 wherein said insulation layer comprises a metal oxide layer.

9. The casting assembly in accordance with claim 1 wherein said insulation layer is comprised of a material selected from zirconia, alumina, titania and silica.

10. The casting assembly in accordance with claim 1 wherein said insulation layer is comprised of a zirconia based material.

11. The casting assembly in accordance with claim 1 wherein said insulation layer has a thickness in the range of 0.01 to 0.25 inch.

12. The casting assembly in accordance with claim 1 wherein said support is a carbon steel metal support.

13. The casting assembly in accordance with claim 1 wherein said support is a metal support.

14. The casting assembly in accordance with claim 1 wherein said support is fabricated from an iron-nickel alloy or an iron-nickel-cobalt alloy having a low coefficient of thermal expansion.

15. The casting assembly in accordance with claim 1 wherein said inductive heater comprises a cooling means.

16. The casting assembly in accordance with claim 15 wherein said cooling means comprises conduits for passing liquid or vapor through said inductive heater.

17. The casting assembly in accordance with claim 16 wherein said liquid is material selected from water, glycol and low melting metal or metal alloys.

18. The casting assembly in accordance with claim 16 wherein said vapor is water vapor.

19. An improved casting assembly for a continuous caster, the assembly designed for transferring molten metal from a molten metal reservoir to a continuously advancing mold for casting molten metal, the assembly comprising:

(a) a metal casting nozzle having an electrically conductive top wall and bottom wall and two side walls joined to said top wall and said bottom wall to form a passage therebetween for flowing molten metal from said reservoir to said mold, said top wall having a first outside surface and said bottom wall having a second outside surface;

(b) an inductive heater positioned on at least one of said first surface and said second surface, said inductive heater positioned to heat said top wall and bottom wall and having a magnetic shield partially surrounding said inductive heater, the shield positioned to direct magnetic flux into said nozzle; and (c) a layer of electrical insulation provided between said inductive heater and said first and second surfaces;

(d) a metal support for supporting said top wall and said bottom wall, a layer of insulation comprised of a material selected from zirconia, alumina, titania and silica provided between said metal support and said top wall and said bottom wall to minimize heating of said metal support and distortion of said top wall and said bottom wall, said metal support electrically insulated from said inductive heater, said magnetic shield positioned to substantially avoid magnetic flux entering said, metal support.

20. The casting assembly in accordance with claim 19 wherein said assembly is comprised of two inductive heaters disposed substantially opposite each other.

21. The casting assembly in accordance with claim 19 wherein said inductive heater comprises a cooling means.

22. In an improved belt caster for continuous casting molten metal wherein molten metal is transferred from a molten metal reservoir through an improved nozzle assembly to a continuously advancing mold formed by two belts for casting molten metal into solidified form, the nozzle assembly comprising:

(a) a nozzle having an electrically conductive top wall and bottom wall and two side walls joined to said top wall and said bottom wall to form a passage therebetween for flowing molten metal from said reservoir to said mold, said top wall having a first outside surface and said bottom wall having a second outside surface;

(b) an inductive heater positioned on at least one of said first surface and said second surface, said inductive heater positioned to heat said top wall and bottom wall and having a magnetic shield partially surrounding said inductive heater, the shield positioned to direct magnetic flux into said nozzle; and (c) a layer of electrical insulation provided between said inductive heater and said first and second surface;

(d) a metal support for supporting said top wall and said bottom wall, a layer of insulation provided between said metal support and said top wall and said bottom wall to minimize heating of said metal support and distortion of said top wall and said bottom wall, said metal support electrically insulated from said inductive heater, said magnetic shield positioned to substantially avoid magnetic flux entering said metal support.

23. The belt caster in accordance with claim 22 wherein an inductive heater is positioned on said insulation layer on said top surface and second inductive heater is positioned on said insulation layer on said bottom surface.

24. The belt caster in accordance with claim 22 wherein said insulation layer comprises a metal oxide layer.

25. The belt caster in accordance with claim 22 wherein said layer of insulation is comprised of a material selected from zirconia, alumina, titania and silica.

26. In an improved roll caster for continuous casting molten metal wherein molten metal is transferred from a molten metal reservoir through an improved nozzle assembly to a continuously advancing mold formed by two rolls for casting molten metal into solidified form, the nozzle assembly comprising:

(a) a metal casting nozzle having an electrically conductive top wall and bottom wall and two side walls joined to said top wall and said bottom wall to form a passage therebetween for flowing molten metal from said reservoir to said mold, said top wall having a first outside surface and said bottom wall having a second outside surface;

(b) a layer of insulation provided on said first and second outside surfaces, said layer of insulation comprised of a material selected from zirconia, alumina, titania and silica;

(c) an inductive heater positioned on said layer of insulation on at least one of said first surface and said second surface, said inductive heater positioned to heat said top wall and bottom wall and having a magnetic shield partially surrounding said inductive heater, the shield positioned to direct magnetic flux into said nozzle; and (d) a metal support for supporting said top wall and said bottom wall, said metal support thermally insulated from said top wall and said bottom wall to minimize heating of said metal support and distortion of said top wall and said bottom wall, said metal support electrically insulated from said inductive heater, said magnetic shield positioned to substantially avoid magnetic flux entering said metal support.

27. The roll caster in accordance with claim 26 wherein an inductive heater is positioned on said layer of insulation on said top surface and second inductive heater is positioned on said layer of insulation on said bottom surface.

28. The roll caster in accordance with claim 26 wherein said insulation layer comprises a metal oxide layer.

29. A method of casting molten metal comprising:

(a) providing a body of molten metal;

(b) providing a mold for casting molten metal into solid metal;

(c) providing a nozzle assembly designed for transferring molten metal from said body to said mold, said assembly comprising:

(i) an electrically conductive top wall and bottom wall and two side walls joined to said top wall and said bottom wall to form a passage therebetween for flowing molten metal from said reservoir to said mold, said top wall having a first outside surface and said bottom wall having a second outside surface;

(ii) an inductive heater positioned on at least one of said first surface and said second surface, said inductive heater positioned to heat said top wall and bottom wall and having a magnetic shield partially surrounding said inductive heater, the shield positioned to direct magnetic flux into said nozzle;

(iii) a layer of electrical non-conductive thermal insulation positioned between said inductive heater and said first and second surfaces; and (iv) a metal support for supporting said top wall and said bottom wall, said metal support thermally insulated from said top wall and said bottom wall to minimize distortion of said top wall and said bottom wall upon heating, and said metal support electrically insulated from said inductive heater, said magnetic shield positioned to substantially avoid magnetic flux entering said metal support;

(d) preheating said top wall and said bottom wall by passing electrical current through said inductive heater; and (e) passing molten metal tluhough said passage and casting said molten metal into solidified forms.

30. The method in accordance with claim 29 wherein said thermal layer of insulation is comprised of a material selected from the group consisting of zirconia, alumina, titania and silica.

31. The method in accordance with claim 30 including preheating said nozzle to a temperature in the range of 450° to 950° F.

32. A method for continuously casting molten metal comprising:

(a) providing a body of molten metal;

(b) providing a continuously advancing mold for casting molten metal into solid metal;

(c) providing a nozzle assembly designed for transferring molten metal from said body to said mold, said assembly comprising:

(i) a nozzle having an electrically conductive top wall and bottom wall and two side walls joined to said top wall and said bottom wall to form a passage therebetween for flowing molten metal from said body to said mold, said top wall having a first outside surface and said bottom wall having a second outside surface; and (d) providing an inductive heater positioned on at least one of said first surface and said second surface, said inductive heater positioned to heat said top wall and bottom wall and having a magnetic shield partially surrounding said inductive heater, the shield positioned to direct magnetic flux into said nozzle;

a layer of electrical insulation between said inductive heater and said surface;

a metal support for supporting said top wall and said bottom wall, said metal support thermally insulated from said top wall and said bottom wall to minimize distortion of said top wall and bottom wall when, said nozzle is heated, said metal support electrically insulated from said inductive heater, said magnetic shield positioned to substantially avoid magnetic flux entering said metal support;

(e) passing a magnetic flux from said inductive heater through said nozzle to heat said nozzle and simultaneously therewith substantially avoiding passing magnetic flux through said support to avoid heating said support with said flux; and (f) passing molten metal through said passage and casting said molten metal into solidified forms.

* * * * *